US006012390A

United States Patent [19]

Ott et al.

[11] Patent Number: 6,012,390

[45] Date of Patent: Jan. 11, 2000

[54] METHOD FOR CONTROLLING THE INKING OF A PRINTING PRESS BY DETERMINING COLOR VALUE GRADIENTS

[75] Inventors: Hans Ott, Regensdorf; Kurt Rüegg, Effretikon, both of Switzerland

[73] Assignee: Heidelberger Druckmaschinen Aktiengesellschaft, Heidelberg, Germany

[21] Appl. No.: 09/188,781

[22] Filed: Nov. 6, 1998

[30] Foreign Application Priority Data

Nov. 6, 1997 [CH] Switzerland ..... 197 49 064

[51] Int. Cl.[7] ..... B41F 1/04

[52] U.S. Cl. ..... 101/365; 395/109; 395/104; 101/366; 347/5; 347/6; 347/19

[58] Field of Search ..... 101/365, 211, 101/171, 484, DIG. 45, DIG. 47, 183, 134, 181, 136, 335, 366, 483, 470, 471, 170, DIG. 49; 395/104, 109, 101; 347/5, 6, 19, 15, 43; 364/526, 402, 551.01, 558, 571.01; 250/316.1, 317.1, 318, 319, 580, 559.01, 582–584, 559.04, 559.2, 559.39; 358/504, 505, 512, 518, 503, 515; 356/429, 394, 425, 407, 406

[56] References Cited

U.S. PATENT DOCUMENTS

| | | | |
|---|---|---|---|
| 4,975,862 | 12/1990 | Keller et al. | 364/526 |
| 5,023,812 | 6/1991 | Pfeiffer | 364/519 |
| 5,182,721 | 1/1993 | Kipphan et al. | 364/526 |
| 5,530,656 | 6/1996 | Six | 364/526 |
| 5,724,437 | 3/1998 | Bucher et al. | 382/112 |
| 5,791,251 | 8/1998 | Kistler et al. | 101/484 |
| 5,841,955 | 11/1998 | Wang | 395/109 |
| 5,854,680 | 12/1998 | Rakitsch | 356/406 |

FOREIGN PATENT DOCUMENTS

| | | | |
|---|---|---|---|
| 0095649 | 12/1983 | European Pat. Off. | B41F 33/00 |
| 0228347 | 7/1987 | European Pat. Off. . | |
| 4415486 | 11/1995 | France . | |
| 19515499 | 10/1996 | France . | |
| 2289018 | 11/1995 | United Kingdom | B41F 33/00 |

OTHER PUBLICATIONS

W.E.S.T. 1.0 English Abstract for EP 95649, Derwent, Jeschke et al., 1983.

*Primary Examiner*—Kimberly L. Asher
*Attorney, Agent, or Firm*—Nils H. Ljungman & Associates

[57] ABSTRACT

Method and apparatus for the determination of the color value gradients of a picture element of a printed image when there are changes in the layer thicknesses of the inks used in the printing, the picture element (4) is photo-electrically scanned in the visible range of the spectrum and also in the near infrared range. From the scanning signals thereby obtained, color coordinates or an approximated subjectively equidistant color system and at least one infrared value is formed. The color value gradients are then calculated from these color coordinates and the at least one infrared value.

9 Claims, 1 Drawing Sheet

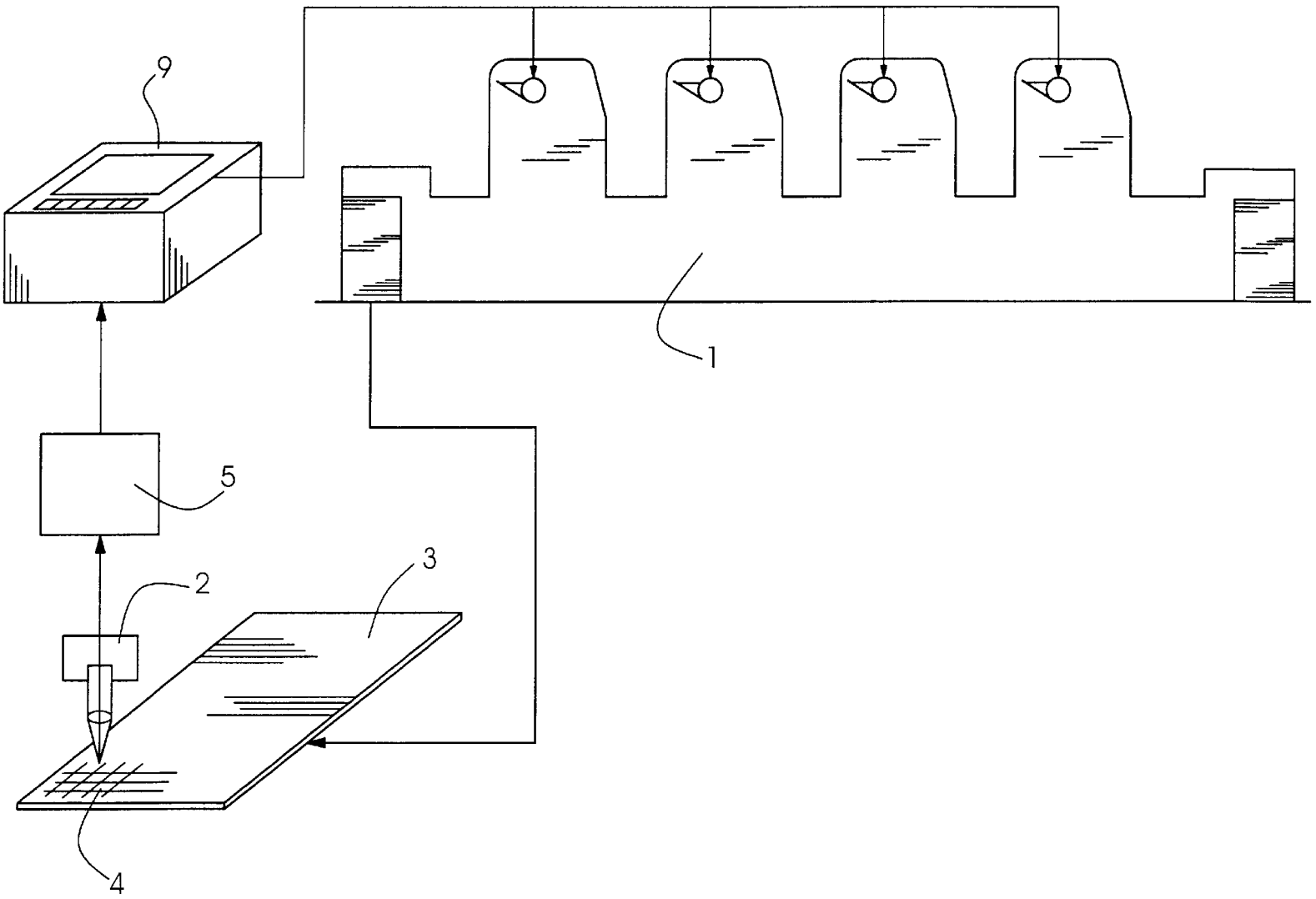
1
3
9
5
2
4

METHOD FOR CONTROLLING THE INKING OF A PRINTING PRESS BY DETERMINING COLOR VALUE GRADIENTS

BACKGROUND OF THE INVENTION

1. Field of the Invention

The present invention relates generally to a method for the determination of color value gradients of a picture element of a printed image when there are changes in the layer thicknesses of the inks used in the printing, whereby the picture element is photo-electrically scanned in the visible region of the spectrum, and the color value gradients are derived from the scanning signals thereby obtained.

2. Background Information

The regulation of inking in modern printing presses, in particular in offset printing, can be advantageously done on the basis of color differences. A typical regulation method based on control by color differences is described in European Patent No. B2-0 228 347 and in German Patent No. 195 15 499 C2, for example. In this method, a sheet to be printed with the printing press is divided colorimetrically into a number of test areas with regard to a selected system of color coordinates. From the color coordinates obtained in this manner, the color difference vectors are calculated to obtain the desired color coordinates with respect to said color coordinate system. These color difference vectors are converted by means of color value gradients into layer thickness change vectors, and the inking of the printing press is regulated on the basis of the layer thickness change vectors converted from the color difference vectors. The test areas used are the fields of the color test strips printed at the same time as the printed image itself.

Scanning devices have recently become available that make it possible to survey the entire image content of a printed sheet by dividing it into a large number of relatively small picture elements at reasonable cost and in a very short time, using colorimetric or spectro-photometric techniques. These scanning devices meet the theoretical instrumentation requirements because they not only use simultaneously printed test strips for the regulation of the inking of a printing press, but also acquire the color information from all the picture elements of the entire actual printed image for this purpose. One problem with this method, which is sometimes called "measurement in the image", however, results from the problem of the black fraction that is present in four-color printing which, as is known, is the result of contributions not only from the color black itself, but also from the colors superimposed on one another. A reliable determination of the color value gradients necessary for the calculation of the input variables for the color regulation for all the very different printing situations that can arise in a printed image is not possible using current methods. An additional problem results from the enormously large computer capacity required, which in practice results in unreasonably long computing times.

OBJECT OF THE INVENTION

On the basis of the known art, one object of the present invention is to significantly improve a method of the type described above so that it can also be used for the "measurement in the image". In particular, an object of the invention is to make it possible to determine color value gradients on any desired picture elements of a printed image, thereby making it possible to reliably separate all the participating print colors, in particular including the print color black. An additional object of the invention is to make it possible to determine the color value gradients with a reasonable expenditure of time and effort and at high speed, and thereby create the conditions for a feasible computer regulation of the printing press on the basis of "measurements in the printed image."

SUMMARY OF THE INVENTION

The present invention teaches that these objects can be accomplished by the method wherein, from the scanning signals of the visible region of the spectrurn, color coordinates (L,a,b) of an approximately subjectively equidistant color system are formed, that the picture element is also scanned photo-electrically in the near-infrared region of the spectrum, that from the scanning signals of the infrared range, at least one infrared value is formed (I), and that the color value gradients (S) are calculated from the color coordinates and the at least one infrared value. Particularly advantageous configurations and refinements of the present invention are described herebelow.

A possible advantageous refinement of the invention includes the fact that the color coordinates and the infrared value color value gradients S can be taken from a predefined table. The table can be calculated using a mathematical model of the printing press used to produce the printed image from measurements taken on the full-tone areas printed with the printing press, and taking into consideration the characteristics of the printing press.

Still another advantageous refinement in accordance with the present invention includes that for a specified first number of discrete half-tone value combinations $R_{iR}$, color value gradients $S_{iR}$ corresponding to the colors used in the printing can be calculated and stored in a half-tone color table RFT, that for the picture element 4, the corresponding half-tone value combination R of the colors used in the printing can be calculated from the color coordinates L,a,b and the at least one infrared value I, and that the color value gradients $S_{iR}$ from the half-tone color table RFT are assigned to the picture element, when the corresponding discrete half-tone value combination $R_{iR}$ of the gradients in question is closest to the half-tone value combination R calculated for the picture element.

A further possible advantageous refinement of the present invention resides in the method wherein a four-dimensional color space is formed, the coordinates of which are the color coordinates L,a,b and the infrared value I, that in this four-dimensional color space, a specified second number of discrete color sites $F_{iF}$ are defined, for each of these discrete color sites the corresponding half-tone value combination R of the colors used in the printing is calculated, this half-tone combination R is replaced by the closest discrete half-tone value combination $R_{iR}$ taken from the half-tone color value table RFT and the discrete color sites $F_{iF}$ are stored in correspondence to the discrete half-tone value combinations $R_{iR}$ in a half-tone index table RIT, and that for the determination of the color value gradients of the picture element from the color coordinates L,a,b and the infrared value I of this picture element, the coordinates of a color site are formed in the four-dimensional color space, this color site is replaced by the closest discrete color site $F_{iF}$, the discrete half-tone value combination $R_{iR}$ corresponding to this discrete color site $F_{iF}$ is taken from the half-tone index table RIT, the color value gradient $S_{iR}$ corresponding to this discrete half-tone value combination $R_{iR}$ is taken from the half-tone color table RFT, and this color value gradient $S_{iR}$ is assigned to the picture element.

In accordance with another possible refinement of the present invention the half-tone value combination $R_{iR}$ and the color value gradients $S_{iR}$ are determined by interpolation from the half-tone color table RFT.

In at least one embodiment of the present invention the term "four-dimensional" as used herein, can possibly refer to a four-dimensional array or matrix.

The above discussed embodiments of the present invention will be described further hereinbelow with reference to the accompanying figures. When the word "invention" is used in this specification, the word "invention" includes "inventions", that is plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of the application may include more than one invention, and, in the event that there is more than one invention, that these inventions may be patentable and non-obvious one with respect to the other.

BRIEF DESCRIPTION OF THE DRAWINGS

The invention is described in greater detail below with reference to the accompanying drawing, in which:

The sole FIGURE shows a schematic diagram of a system for the control or regulation of a printing press.

DESCRIPTION OF THE PREFERRED EMBODIMENT

In the sole FIGURE, a printing press 1, in particular a multi-color offset printing press, produces printed sheets 3 that have the desired printed image and any additional printing control elements that may be necessary. The printed sheets are extracted from the current printing process and fed to a spectro-photometric scanning device 2. This scanning device scans the printed sheets essentially over the entire surface, picture element by picture element. The size of the individual picture element 4 is typically approximately 2.5 mm×2.5 mm, which corresponds to approximately 130,000 picture elements 4 on a printed sheet 3 of conventional dimensions. The scanned values—typically spectral remission values—generated by the scanning device 2 are analyzed in an analysis device 5 that essentally comprises a computer and are processed into input variables for a control device 9 associated with the printing press 1 which, for its part, controls the ink dispensing mechanisms of the printing press 1 on the basis of these input variables. The input variables, in the case of an offset printing press 1, are typically zonal layer thickness changes for the individual printing inks used in the printing. The above mentioned input variables or layer thickness changes are determined by a comparison of the scanned values or of variables derived from them, in particular color measurements (color sites or color vectors) of an OK sheet 3, or correctly colored sheet, with the corresponding variables of a printed sheet 3 taken from the current printing process, in the sense that the changes in the settings of the inking mechanisms of the printing press 11 effected by the input variables or layer thickness changes result in the best possible approximation of the color impression of the printed sheets 3 currently being printed to the OK sheets 3. For comparison, instead of an OK sheet 3, an additional reference can also be used, for example an approximately corresponding specification or corresponding values obtained from preliminary printing stages.

In one possible embodiment of the present invention the scanning device 2 can comprise a single device capable of scanning in both the visible region of the spectrum and the infra-red region of the spectrum. In one possible embodiment the scanning device 2 can include an arrangement for scanning in the infra-red region and arrangement for scanning in the visible region of the spectrum. It is also possible that the scanning device 2 could include two separate devices, with one device used to scan in the visible region of the spectrum and another to scan in the infra-red region of the spectrum.

The system illustrated essentially corresponds to that extent to conventional systems and methods for inking regulation of printing presses 1, such as, for example, those described in detail in DE-A 44 15 486, and therefore does not require any additional explanation for a technician skilled in the art.

A first essential aspect of the present invention is the inclusion of the printing color black in the determination of the color value gradients and the input variables calculated using this color for the control of the printing press. For this purpose, the printed sheets 3 are surveyed not only in the visible spectral range (approximately 400– 700 nm), but also in at least one point in the near-infrared, where only the print color black has a significant absorption. It is thereby possible to selectively detect the influence of the print color black on the color impression. The remission spectra of the individual picture elements 4 therefore consist of remission values in the visible spectral range, typically 16 remission values at intervals of 20 nm each, and one remission value in the near-infrared range. From the remission values of the visible spectral range, color values (color coordinates, color vectors, color sites) regarding a selected color space are calculated. Preferably, a subjectively equidistant color space is selected for this purpose, typically something like the L,a,b, color space defined by the CIE (Commission Internationale de l'Eclairage). The calculation of the color values L,a,b from the spectral remission values of the visible spectral range is standardized by CIE and therefore does not require any explanation. The remission value in the near-infrared is converted into an infrared value I, which corresponds qualitatively to the brightness value L of the color space. This conversion is done in a manner analogous to the calculation formula for L according to the equation:

$$I = 116 \cdot \sqrt[3]{\frac{I_i}{I_{in}}} - 16$$

where $I_i$ indicates the infrared remission measured in the picture element 4 in question and $I_{in}$ the infrared remission measured at an unprinted point on the printed sheet 43.

The infrared value I, like the brightness value L, can therefore assume essentially only values from 0–100. The calculation of the color values L,a,b and of the infrared value I from the spectral remission values occurs in the evaluation device 5. For the sake of completeness, it should be noted that the color values L,a,b (or corresponding values of another color space) could also be determined without spectral scanning, using suitable colorimetric devices.

The color and infrared values L,a,b and I available after the scanning of a printed sheet 3 for each individual picture element 4 form the starting point for the calculation of the color value gradient, and thereby the input variables for the printing press control device 9. These calculations are also performed in the evaluation device 5. For the following description, the value quadruples, or set of four values, determined for each picture element 4 and comprising the three color values L,a,b (or the corresponding values of another color system) and the infrared value I are designated, for purposes of simplification, as a (four-dimensional) color vector F of the picture element 4 in question, i.e.:

$$F=(L, a, b, I)$$

In this case, the term "color site" in the four-dimensional color space is used to designate a point in the color space, the four coordinates of which are the four components of the color vector. The color difference of a picture element 4 from a reference picture element 4 or from the corresponding picture element 4 of a reference, typically of an OK sheet 3, is designated the color difference vector ΔF, which is calculated according to the equation:

$$\Delta F=(\Delta L, \Delta a, \Delta b, \Delta I)=F_i-F_r=(L_i-L_r, a_i-a_r, b_i-b_r, I_i-I_r)$$

where the values designated by the index i are those of the picture element 4 in question and the values designated by the index r are those of the components of the color vector of the reference picture element 4 or of the corresponding picture element 4 of the OK sheet 3. The color vectors of the picture elements of the OK sheet or of another reference are frequently also designated the desired color vectors. As the color difference ΔE between two picture elements 4 of a picture element 4 and of the corresponding picture element 4 of the OK sheet 3 is the absolute amount of the color difference vector ΔF in question, i.e.

$$\Delta E=|\Delta F|=\{(L_i-L_r)^2+(a_i-a_r)^2+(b_i-b_r)^2+(I_i-I_r)^2\}^{0.5}$$

where the indices i and r have the same meaning as indicated above. The calculator in the evaluation device 5 calculates the color difference vector ΔF for each picture element 4 of the current printed sheet 3 from the color vectors F determined on this sheet and on the OK sheet 3.

The input variables to be determined for the printing press control device 9, i.e. the zonal relative layer thickness changes for the individual printing inks used in the printing, are also illustrated in the form of vectors for ΔD, which is also illustrated below in the form of a vector and is called the layer thickness change vector ΔD for short:

$$\Delta D=(\Delta D_c, \Delta D_g, \Delta D_m, \Delta D_s)$$

The indices c, g, m and s thereby stand for the colors cyan (c), yellow (g), magenta (m) and black (s), and the correspondingly indexed components of the vector are the relative layer thickness changes for the color indicated by the index. The current layer thicknesses themselves can be illustrated as the layer thickness vector D:

$$D=(D_c, D_g, D_m, D_s)$$

where the indices have the same meanings as indicated above.

According to the teaching of the above mentioned EP-B2 0 228, 347, for example, the relative layer thickness changes ΔD of the individual printing inks being used necessary for the compensation of a color deviation from the reference (OK sheet 3) can be calculated from the color difference vectors ΔF determined from a current printed sheet 3 with respect to the reference (OK sheet 3) according to the equation $$\Delta F=S*\Delta D$$

where S is a sensitivity matrix that contains as coefficients the partial derivatives of the four components L, a, b, I of the color vector F according to the four components $D_c$, $D_g$, $D_m$, $D_s$ of the layer thickness vector D:

$$S=\begin{Bmatrix} \frac{dL}{dD_c} & \frac{dL}{dD_g} & \frac{dL}{dD_m} & \frac{dL}{dD_s} \\ \frac{da}{dD_c} & \frac{da}{dD_g} & \frac{da}{dD_m} & \frac{da}{dD_s} \\ \frac{db}{dD_c} & \frac{db}{dD_g} & \frac{db}{dD_m} & \frac{db}{dD_s} \\ \frac{dI}{dD_c} & \frac{dI}{dD_g} & \frac{dI}{dD_m} & \frac{dI}{Dd_S} \end{Bmatrix}$$

The coefficients of the sensitivity matrix S are generally designated color value gradients. In the following description, the summary term "sensitivity matrix" will be used for these 16 color value gradients.

The sensitivity matrix S is a linear substitution model for the relationship between the changes in the layer thicknesses of the printing inks used in the printing and the resulting changes in the printed impression of the picture element 4 printed with the changed layer thickness values. The sensitivity matrix S is not identical for all color sites in the color space, but strictly speaking is valid only in the immediate vicinity of a color site, i.e. strictly speaking, a unique sensitivity matrix S must be used for each measured color vector F of the individual picture elements 4 in the equation ΔF=S*ΔD.

On the assumption that the sensitivity matrices S are known, the matrix equation ΔF=S*ΔD can be solved for ΔD, ($\Delta D=S^{-1}*\Delta F$) according to the known rules of matrix calculations.

The visual color impression (technically the color value, color site or color vector) of a picture element 4 is determined in offset half-tone printing by the percentage half-tone, or raster, value (surface coverage) of the printing inks used, and to a lesser extent by the layer thicknesses of the inks. The half-tone values or coverages (0–100%) are defined by the basic printing plate and are practically unchanged. Under some printing conditions, an influence can be exerted on the printed impression and thus on the regulation of the printing press only by means of the layer thicknesses of the printing inks used. The expressions "half-tone value" and "coverage" are used synonymously below. The totality of all possible combinations R of percentage half-tone values of the printing inks used (generally cyan, yellow, magenta, black) are designated the half-tone space (four-dimensional) below.

In other possible embodiments of the present invention it is possible that the half-tone values could be considered or referred to as grid values, screen values or lattice values.

Under specified printing conditions (characteristics of the printing press, nominal layer thicknesses, stock to be printed, inks used etc.), each half-tone value combination R corresponds to a precisely defined color impression or color vector F of the picture element 4 printed with this half-tone value combination R. There is thus a clear correspondence between the half-tone value combination R and the color site or color vector F. The half-tone space can be uniquely simulated in the color space, whereby, however, the color space is not completely occupied, because it also contains unprintable color sites. On the other hand, there is in general no unique relationship. The color vector F that belongs to an arbitrary half-tone value combination R can be determined empirically by test printings or by means of a suitable model that describes the printing process under the printing conditions with sufficient accuracy. A suitable model is given, for example, by the known Neugebauer equations for four-color offset printing. The model requires a knowledge of the remission spectra of single-color full tones (or solid colors), several overprints of full tones and several half-tone fields of all the printing inks used in the printing at the nominal layer thicknesses of the inks. These remission spectra can be measured very easily by means of a test printing. If the characteristics of the printing press 1 are known, all that is required is simple measurements on fill tones.

Using the model described above, it is possible, using the methods of the known art, to determine the (16) coefficients of the sensitivity matrix S corresponding to this half-tone value combination for an arbitrary half-tone value combination R. All that is necessary is to change the nominal layer thicknesses of the printing inks used in the model, preferably by 1% each, for example, and with these changed layer thicknesses to calculate the corresponding color vectors and the corresponding color difference vectors with respect to the color vector resulting from the nominal layer thicknesses. These color difference vectors ΔF and the underlying layer thickness change vectors ΔD are inserted into the equation ΔF=S*ΔD and the equation is solved for the coefficients of the sensitivity matrix S.

In accordance with an additional essential aspect of the invention, on the basis of the model described above, the invention teaches that a limited number of potential half-tone value combinations R of the corresponding color vector F and the corresponding sensitivity matrix S are calculated in advance and are stored in the form of a table. This table, which contains the totality of all the sensitivity matrices S and color vectors F calculated in this manner, is designated the half-tone color table (RFT) below.

For the calculation of the layer thickness change vectors ΔD from the equation ΔF=S*ΔD, as described above, a knowledge of the sensitivity matrix S corresponding to each respective color site or color vector F, or in general to each picture element 4, is necessary. To obtain this information, the invention also teaches that the corresponding half-tone value combination R is calculated from the color vector F of the respective picture element 4 according to an additional and particularly advantageous calculation method that is described in greater detail below, and on the basis of this half-tone value combination R, the corresponding sensitivity matrix S is taken from the previously calculated half-tone-color table. In this manner, it is possible without an excessive amount of computer time and effort to rapidly determine the required sensitivity matrix for each picture element 4.

The invention also teaches that, in the half-tone space, a number of, for example, 1296 equidistant discrete half-tone value combinations $R_{iR}$ (6 each discrete half-tone percentages $A_C$, $A_G$, $A_M$, $A_S$ for the ink colors cyan, yellow, magenta and black) can be determined as follows:

| I | 0 | 1 | 2 | 3 | 4 | 5 |
|---|---|---|---|---|---|---|
| $A_C$ | 0 | 20 | 40 | 60 | 80 | 100% |
| $A_G$ | 0 | 20 | 40 | 60 | 80 | 100% |
| $A_M$ | 0 | 20 | 40 | 60 | 80 | 100% |
| $A_S$ | 0 | 20 | 40 | 60 | 80 | 100% |

These 1296 discrete half-tone value combinations $R_{iR}$ are numbered sequentially according to the following formula with a unique half-tone index iR:

$$iR=i(A_C)*5^0+i(A_G)*5^1+i(A_M)*5^2 i(A_S)*5^3$$

i(AC) . . . is thereby defined as the value of the index i for the respective discrete half-tone value of the respective color. For each of these 1296 discrete half-tone value combinations $R_{iR}$, a sensitivity matrix $S_{iR}$ is calculated and stored in the half-tone-color table. The calculated color vector $F_{iR}$ corresponding to the discrete half-tone value combinations $R_{iR}$ is also stored in the table. In total, therefore, the half-tone-color table RFT contains 1296 color vectors $R_{IR}$ and 1296 corresponding sensitivity matrices $S_{iR}$.

The quantification of the half-tone space is preferably done in two stages. In the first stage, the corresponding color vectors and the corresponding sensitivity matrices are calculated for only 256 discrete half-tone value combinations (corresponding to four discrete half-tone percentages 0%, 40%, 80% and 100% for each of the colors cyan, yellow, magenta and black), using the offset printing model. In the second stage, the corresponding color vectors and sensitivity matrices for the missing half-tone percentages 20% and 60% are calculated by linear interpolation from the color vectors and sensitivity matrices of the respective 16 closest discrete half-tone value combinations.

The result is a total of, again, 1296 discrete half-tone value combinations $R_{iR}$ with 1296 corresponding discrete color vectors $F_{iR}$ and 1296 corresponding sensitivity matrices $S_{iR}$. Of course, the half-tone space can also be reduced to another number of discrete half-tone combinations, for example 625 or 2401, although the number 1296 represents a substantially optimal compromise between accuracy and computer time in actual practice.

A color vector F determined for a picture element 4 is then assigned to the sensitivity matrix, the corresponding discrete half-tone value combination $R_{iR}$ of which is closest to the half-tone value combination R calculated from the color vector F. In other words, the calculated half-tone value combination R is replaced by the respective closest discrete half-tone value combination $R_{iR}$ and is given the previously calculated sensitivity matrix $S_{iR}$ for this discrete half-tone value combination $R_{iR}$.

In one variant of the method, the half-tone value combinations ($R_{iR}$) and the color value gradients ($S_{iR}$) can be determined by interpolation from the half-tone color table (RFT).

The invention also teaches, for the determination of the half-tone value combination R from the color vector F, that the color space (including the infrared value I four-dimensionally) is subjected to a quantification, i.e. it is divided into a number of sub-spaces. For that purpose, in the color space, a number of discrete color sites $F_{iF}$, each with discrete coordinates, are defined. The quantification of the four-dimensional color space can be done, for example, so that each dimension L, a, b, I of the color space can assume only 11 discrete values, which gives a total of 14,641 discrete color sites $F_{iF}$:

| I | 0 | 1 | 2 | 3 | 4 | 5 | 6 | 7 | 8 | 9 | 10 |
|---|---|---|---|---|---|---|---|---|---|---|---|
| L | 0 | 10 | 20 | 30 | 40 | 50 | 60 | 70 | 80 | 90 | 100 |
| a | −75 | −60 | −45 | −30 | −15 | 0 | 15 | 30 | 45 | 60 | 75 |
| b | −45 | −30 | −15 | 0 | 15 | 30 | 45 | 60 | 75 | 90 | 105 |
| I | 0 | 10 | 20 | 30 | 40 | 50 | 60 | 70 | 80 | 90 | 100 |

These 14,641 discrete color sites $F_{iF}$ are numbered with a unique color site index iF according to the formula indicated below:

$$iF=i(L)*11^0+i(a)*11^1+i(b)*11^2+i(I)*11^3$$

For these discrete color sites $F_{iF}$ of the color space, the particularly advantageous calculation method described in greater detail is used to find the corresponding half-tone value combinations $R_{iF}$, and, to the extent that they do not coincide with a discrete half-tone value combination $R_{iR}$, they are replaced by the respective closest discrete half-tone value combination $R_{iR}$. The result is a unique, previously calculated simulation of the 14,641 discrete color sites $F_{iF}$ of the (four-dimensional) color space on the 1296 discrete half-tone value combinations $R_{iR}$ of the (likewise four-dimensional) half-tone space. This simulation, as noted above, is calculated in advance and is stored in a table designated the half-tone index table (RIT) below.

To determine the half-tone value combinations R from the color vectors F determined for the picture elements 4, each color vector F determined for a picture element 4 is replaced by the closest discrete color site $F_{iF}$. From the half-tone index table RIT, the discrete half-tone value combination $R_{iR}$ corresponding to this discrete color site $F_{iF}$ is taken, and on the basis of this $R_{iR}$, the corresponding sensitivity matrix $S_{iR}$ is read from the half-tone color table RFT, establishing a correspondence with the color vector F and thus the picture element 4. In this manner, using relatively little computer time and capacity, for each arbitrary picture element 4, the sensitivity matrix S can be determined on the basis of the color vector F with sufficient precision for practical purposes.

In the preceding portion of the explanation, it was assumed that the corresponding half-tone value combinations R can be calculated from the color vectors F. The following sections explain an additional essential teaching of the invention, namely how this can be done particularly advantageously.

First the (four-dimensional) color space is divided into 81 partial areas $T_{iT}$ as follows:

| I | 0 | 1 | 2 |
|---|---|---|---|
| L(0 . . . 120) | 0 . . . 20 . . . 40 | 40 . . . 60 . . . 80 | 80 . . . 100 . . . 120 |
| a(−90 . . . +90) | −90 . . . −60 . . . −30 | −30 . . . 0 . . . +30 | +30 . . . +60 . . . +90 |
| b(−60 . . . +120) | −60 . . . −30 . . . 0 | 0 . . . +30 . . . +60 | +60 . . . +90 . . . +120 |
| I(0 . . . 120) | 0 . . . 20 . . . 40 | 40 . . . 60 . . . 80 | 80 . . . 100 . . . 120 |

The total of 81 partial areas $T_{iT}$ are assigned a unique identifying partial area index iT according to the following formula:

$$iT=i(L)*3^0+i(a)*3^1+i(b)*3^2+i(I)*3^3$$

Within each partial area $T_{iT}$, the relationship between the color vector F and the corresponding half-tone value combination R written as a half-tone vector A is given a linear approximation by the following matrix equation:

$$A=U_{iT}*F$$

where A is the half-tone vector with the half-tone percentage values $A_C$, $A_G$, $A_M$, $A_S$ of the four colors being used as components, and $U_{iT}$ is a conversion matrix with 16 coefficients which are the partial derivations (gradients) of the components of the half-tone vector according to the components of the color vector. If the conversion matrices $U_{iT}$ of the individual partial areas $T_{it}$ are known, then for each color vector F, the corresponding half-tone vector A or the corresponding half-tone value combination R can be calculated.

The problem is therefore reduced to the calculation of the conversion matrices $U_{iT}$ for the individual partial areas $T_{iT}$, or more accurately for the color vectors $F_{iT}$ of their midpoints. The calculation of the conversion matrices is performed on the basis of a weighted linear equation to calculate the most probable values with the values of the half-tone color table RFT described above, i.e. the 1296 discrete half-tone value combinations $R_{iR}$ and the corresponding discrete color vectors $F_{iR}$. For the equation to calculate the most probable values, the essential requirement for each partial area $T_{iT}$ is essentially only the inversion of a 4×4 matrix. The weight of the interpolation nodes, i.e. the discrete color sites $F_{iR}$ of the half-tone color table, for the calculation of the most probable values, is determined on the basis of a suitable function with the color difference between the interpolation nodes and the respective color vector $F_{iT}$ as a parameter. The calculation of the most probable values is linear, i.e. there are discontinuities at the transitions between the individual partial areas $T_{iT}$, but they are irrelevant for actual practical applications.

The sensitivity matrices S determined on the basis of the above explanations for the individual picture elements 4, or the color value gradients that form these matrices, can now be used for the calculation of the input variables described above for the regulation of the inking of the printing press.

One feature of the invention resides broadly in the method for the determination of the color value gradients of a picture element of a printed image when there are changes in the layer thicknesses of the inks used in the printing, whereby the picture element is photo-electrically scanned in the visible region of the spectrum, and the color value gradients are derived from the scanning signals thereby obtained, characterized by the fact that from the scanning signals of the visible region of the spectrum, color coordinates (L,a,b) of an approximately subjectively equidistant color system are formed, that the picture element 4 is also scanned photo-electrically in the near-infrared region of the spectrum, that from the scanning signals of the infrared range, at least one infrared value is formed I, and that the color value gradients S are calculated from the color coordinates and the at least one infrared value.

Another feature of the invention resides broadly in the method characterized by the fact that the color coordinates and the infrared value color value gradients S are taken from a pre-defined table.

Yet another feature of the invention resides broadly in the method characterized by the fact that the table is calculated using a mathematical model of the printing press 1 used to produce the printed image from measurements taken on the full-tone areas printed with the printing press 1, and taking into consideration the characteristics of the printing press 1.

Still another feature of the invention resides broadly in the method characterized by the fact that for a specified first number of discrete half-tone value combinations $R_{iR}$, color value gradients SIR corresponding to the colors used in the printing are calculated and stored in a half-tone color table RFT, that for the picture element 4, the corresponding half-tone value combination R of the colors used in the printing is calculated from the color coordinates L,a,b and the at least one infrared value I, and that the color value gradients $S_{iR}$ from the half-tone color table RFT are assigned to the picture element 4, when the corresponding discrete half-tone value combination $R_{iR}$ of the gradients in question is closest to the half-tone value combination R calculated for the picture element 4.

A further feature of the invention resides broadly in the method characterized by the fact that a four-dimensional color space is formed, the coordinates of which are the color coordinates L,a,b and the infrared value I, that in this four-dimensional color space, a specified second number of discrete color sites $F_{iF}$ are defined, for each of these discrete color sites the corresponding half-tone value combination R of the colors used in the printing is calculated, this half-tone combination R is replaced by the closest discrete half-tone value combination $R_{iR}$ taken from the half-tone color value table RFT and the discrete color sites $F_{iF}$ are stored in correspondence to the discrete half-tone value combinations $R_{iR}$ in a half-tone index table RIT, and that for the determination of the color value gradients of the picture element 4 from the color coordinates L,a,b and the infrared value I of this picture element 4, the coordinates of a color site are formed in the four-dimensional color space, this color site is replaced by the closest discrete color site $F_{iF}$, the discrete half-tone value combination $R_{iR}$ corresponding to this discrete color site $F_{iF}$ is taken from the half-tone index table RIT, the color value gradient $S_{iR}$ corresponding to this discrete half-tone value combination $R_{iR}$ is taken from the half-tone color table RFT, and this color value gradient $S_{iR}$ is assigned to the picture element 4.

Another feature of the invention resides broadly in the method characterized by the fact that the half-tone value combination $R_{iR}$ and the color value gradients $S_{iR}$ are determined by interpolation from the half-tone color table RFT.

The Commission Internationale de l'Eclairage, or International Commission on Illumination, (CIE), has a headquarters at Kegelgasse 27, A-1030 Wien, AUSTRIA, has been recognized as an international standardization body in matters relating to the science and art of lighting.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All or substantially all, of the components and methods of the various embodiments may be used with at least one embodiment or all of the embodiments, if more that one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 197 49 064.9, filed on Nov. 6, 1997, having inventors Hans Ott and Kurt Rüegg, and DE-OS 197 49 064.6 and DE-PS 197 49 064.6, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A method for controlling the application of at least one ink in a printing press, the printing press having at least one ink dispensing mechanism which is controlled by a control device in accordance with input variables which are received from an analysis device, the analysis device having determined the input variables through the analysis of scanned values generated by at least one scanning arrangement, the method comprising the steps of:

dividing a printed image on a printed sheet, printed by the printing press, into a plurality of picture elements;

photoelectric scanning at least one of the picture elements by a scanning arrangement in the visible region of the spectrum;

scanning the at least one picture element by a scanning arrangement in the near-infrared region of the spectrum;

transmitting the scanned values in the visible region of the spectrum and the values in the near-infrared region of the spectrum to an analysis device;

determining color coordinate values from the scanned values in the visible region of the spectrum with reference to a selected color coordinate system;

determining at least one infrared value from the scanned values in the near-infrared region of the spectrum;

processing the color coordinate values and the at least one infrared value to determine color value gradients, upon changes in the layer thicknesses of the ink;

converting the color value gradients into input variables;

transmitting the input variables to a control device; and controlling at least one ink dispensing mechanism by the control device in accordance with the received input variables;

wherein said step of processing the color coordinate values and the at least one infrared value to determine color value gradients, comprises the steps of:

processing the color coordinate values and the at least one infrared value in conjunction with reference values to determine color value gradients; and taking said color coordinates and said infrared value color value gradients from a pre-defined table;

calculating said pre-defined table using a mathematical model of the printing press used to produce the printed image from measurements taken on the full-tone areas printed with the printing press;

taking into consideration the characteristics of the printing press while making said calculation of said pre-defined table;

wherein said step of converting the color value gradients into input variable comprises:

calculating for a specified first number of discrete half-tone value combinations color value gradients corresponding to the colors used in the printing;

storing said calculated color value gradients in a half-tone color table;

calculating for each of said at least one picture element, the corresponding half-tone value combination of the colors used in the printing from the color coordinates and the at least one infrared value; and assigning the color value gradients from the half-tone color table to each of the at least one picture element, when the corresponding discrete half-tone value combination of the gradients in question is closest to the half-tone value combination calculated for the picture element.

2. The method according to claim 1, wherein the step of processing the color coordinate values in conjunction with reference values to determine color value gradients, upon changes in the layer thicknesses of the ink, comprises the steps of:

forming a four-dimensional color space, the coordinates of which are the color coordinates and the infrared value;

defining a specified second number of discrete color sites in this four-dimensional color space;

calculating the corresponding half-tone value combination of the colors used in the printing for each of these discrete color sites;

replacing said half-tone combination by the closest discrete half-tone value combination taken from the half-tone color value table; and storing the discrete color sites in correspondence to the discrete half-tone value combinations in a half-tone index table.

3. The method according to claim 2, wherein said step of determining the color value gradients of the picture element from the color coordinates and the infrared value of this picture element comprises:

forming the coordinates of a color site in the four-dimensional color space;

replacing said color site by the closest discrete color site, taking the discrete half-tone value combination corresponding to this discrete color site from the half-tone index table;

taking the color value gradient corresponding to this discrete half-tone value combination from the half-tone color table, and assigning said color value gradient to one of said at least one picture element.

4. The method according to claim 3 wherein said step of determining the half-tone value combination and the color value gradients comprises determining the half-tone value combination and the color value gradients values by interpolation from the half-tone color table.

5. Method for the determination of the color value gradients of a picture element of a printed image when there are changes in the layer thicknesses of the inks used in the printing, whereby the picture element is photo-electrically scanned in the visible region of the spectrum, and the color value gradients are derived from the scanning signals thereby obtained, characterized by the fact that from the scanning signals of the visible region of the spectrum, color coordinates (L,a,b) of an approximately subjectively equidistant color system are formed, that the picture element (4) is also scanned photo-electrically in the near-infrared region of the spectrum, that from the scanning signals of the infrared range, at least one infrared value is formed (I), and that the color value gradients (S) are calculated from the color coordinates and the at least one infrared value;

characterized by the fact that the color coordinates and the infrared value color value gradients (S) are taken from a pre-defined table;

characterized by the fact that the table is calculated using a mathematical model of the printing press (1) used to produce the printed image from measurements taken on the full-tone areas printed with the printing press (1), and taking into consideration the characteristics of the printing press (1); and characterized by the fact that for a specified first number of discrete half-tone value combinations (RiR), color value gradients (SiR) corresponding to the colors used in the printing are calculated and stored in a half-tone color table (RFT), that for the picture element (4), the corresponding half-tone value combination (R) of the colors used in the printing is calculated from the color coordinates (L,a,b) and the at least one infrared value (I), and that the color value gradients (SiR) from the half-tone color table (RFT) are assigned to the picture element (4), when the corresponding discrete half-tone value combination (RiR) of the gradients in question is closest to the half-tone value combination (R) calculated for the picture element (4).

6. Method as claimed in claim 5, characterized by the fact that a four-dimensional color space is formed, the coordinates of which are the color coordinates (L,a,b) and the infrared value (I), that in this four-dimensional color space, a specified second number of discrete color sites ($F_{iF}$) are defined, for each of these discrete color sites the corresponding half-tone value combination (R) of the colors used in the printing is calculated, this half-tone combination (R) is replaced by the closest discrete half-tone value combination ($R_{iR}$) taken from the half-tone color value table (RFT) and the discrete color sites ($F_{iF}$) are stored in correspondence to the discrete half-tone value combinations ($R_{iR}$) in a half-tone index table (RIT), and that for the determination of the color value gradients of the picture element (4) from the color coordinates (L,a,b) and the infrared value (I) of this picture element (4), the coordinates of a color site are formed in the four-dimensional color space, this color site is replaced by the closest discrete color site ($F_{iF}$), the discrete half-tone value combination ($R_{iR}$) corresponding to this discrete color site ($F_{iF}$) is taken from the half-tone index table (RIT), the color value gradient ($S_{iR}$) corresponding to this discrete half-tone value combination ($R_{iR}$) is taken from the half-tone color table (RFT), and this color value gradient ($S_{iR}$) is assigned to the picture element (4).

7. Method as claimed in claim 6 characterized by the fact that the half-tone value combination ($R_{iR}$) and the color value gradients ($S_{iR}$) are determined by interpolation from the half-tone color table (RFT).

8. A method for correcting the color values of at least one picture element of a printed image when there are changes in the layer thicknesses of the inks used in the printing, the method comprising the steps of:

dividing a printed image on a printed sheet, printed by the printing machine, into at least one picture element;

photo-electrically scanning said at least one picture element by a scanning arrangement in the visible region of the spectrum;

scanning the at least one picture element by a scanning arrangement in the infrared region of the spectrum;

processing the scanned values from the visible region of the spectrum and the scanned values from the infrared region of the spectrum to provide at least one input value;

using said at least one input value to correct the color values for subsequent picture elements to be printed;

wherein said step of processing the scanned values from the visible region of the spectrum and the scanned values from the infrared region of the spectrum to provide at least one input value comprises the steps of:

determining color coordinate values from the scanned values in the visible region range with reference to a selected color coordinate system;

determining at least one infrared value from the scanned values in the near-infrared region range;

processing the color coordinate values and the at least one infrared value to determine color value gradients; and converting the color value gradients into said at least one input value;

wherein said step of processing the color coordinate values in conjunction with reference values to determine color value gradients, comprises:

taking said color coordinates and said infrared value color value gradient from a pre-defined table;

calculating said pre-defined table using a mathematical model of the printing press used to produce the printed image from measurements taken on the full-tone areas printed with the printing press; and taking into consideration the characteristics of the printing press while making said calculation of said pre-defined table;

wherein said step of converting the color value gradients into input variable comprises:

calculating for a specified first number of discrete half-tone value combinations, color value gradients corresponding to the colors used in the printing;

storing said calculated color value gradients in a half-tone color table;

calculating for each of said at least one picture element, the corresponding half-tone value combination of the colors used in the printing from the color coordinates and the at least one infrared value; and assigning the color value gradients from the half-tone color table to each of the at least one picture element, when the corresponding discrete half-tone value combination of the gradients in question is closest to the half-tone value combination calculated for the picture element.

9. The method according to claim 8 wherein the step of processing the color coordinate values in conjunction with reference values to determine color value gradients, upon changes in the layer thicknesses of the ink, comprises the steps of:

forming a four-dimensional color space, the coordinates of which are the color coordinates and the infrared value;

defining a specified second number of discrete color sites in this four-dimensional color space;

calculating the corresponding half-tone value combination of the colors used in the printing for each of these discrete color sites;

replacing said half-tone combination by the closest discrete half-tone value combination taken from the half-tone color value table; and storing the discrete color sites in correspondence to the discrete half-tone value combinations in a half-tone index table;

wherein said step of determining the color value gradients of the picture element from the color coordinates and the infrared value of this picture element comprises:

forming the coordinates of a color site in the four-dimensional color space;

replacing said color site by the closest discrete color site;

taking the discrete half-tone value combination corresponding to this discrete color site from the half-tone index table;

taking the color value gradient corresponding to this discrete half-tone value combination from the half-tone color table, and assigning said color value gradient to one of said at least one picture element; and wherein said step of determining the half-tone value combination and the color value gradients comprises determining the half-tone value combination and the color value gradients values by interpolation from the half-tone color table.

* * * * *

UNITED STATES PATENT AND TRADEMARK OFFICE

CERTIFICATE OF CORRECTION

PATENT NO. : 6,012,390
DATED : January 11, 2000
INVENTOR(S) : Hans Ott and Kurt Rüegg It is certified that error appears in the above-identified patent and that said Letters Patent is hereby corrected as shown below:

Title page,
Item [30], after 'November 6, 1997' delete "[CH] Swtizerland" and insert -- [DE] Federal Republic of Germany --.

Column 7,
Line 10, after 'on', delete "fill" and insert -- full --.
Line 65, delete the entire equation listed as "$iR=i(A_C)*5^0+i\ (A_G)\ *5^1+i(A_M)*5^2 i(A_S)*5^3$"

and insert

-- $iR=i(A_C)*5^0+i(A_G)*5^1+i\ (A_M)*5^2+i\ (A_S)\ *5^3$ --.

Column 10,
Line 59, after 'gradients', delete "SIR" and insert -- $S_{iR}$ --.

Signed and Sealed this

Twenty-fifth Day of September, 2001

*Attest:*

Nicholas P. Godici

*Attesting Officer*

NICHOLAS P. GODICI
*Acting Director of the United States Patent and Trademark Office*